US005520453A

United States Patent [19]

Aoki et al.

[11] Patent Number: 5,520,453

[45] Date of Patent: May 28, 1996

[54] HEAT INSULATING DOOR WALL STRUCTURE

[75] Inventors: Takashi Aoki; Kouji Yamamoto; Kouji Maeda; Takuya Matsumoto, all of Kusatsu, Japan

[73] Assignee: Matsushita Refrigeration Company, Osaka-fu, Japan

[21] Appl. No.: 288,876

[22] Filed: Aug. 10, 1994

Related U.S. Application Data

[63] Continuation of Ser. No. 972,893, Nov. 6, 1992, abandoned.

[30] Foreign Application Priority Data

Nov. 7, 1991 [JP] Japan ..... 3-291166
Nov. 13, 1991 [JP] Japan ..... 3-296927

[51] Int. Cl.[6] ..... E06B 3/00; A47B 96/04

[52] U.S. Cl. ..... 312/406; 312/234; 49/DIG. 1; 49/504

[58] Field of Search ..... 312/401, 405, 312/406, 406.1, 204, 234; 49/504, DIG. 1; 40/611

[56] References Cited

U.S. PATENT DOCUMENTS 3,793,756 2/1974 Kay et al. ..... 40/611 X
4,732,432 3/1988 Keil et al. ..... 312/406.2
4,844,535 7/1989 Farmont ..... 49/504 X
4,998,382 3/1991 Kostos et al. ..... 49/504 X

FOREIGN PATENT DOCUMENTS 751491 9/1933 France .
2618481 1/1989 France .
2186311 12/1987 United Kingdom .

*Primary Examiner*—Peter Vo
*Assistant Examiner*—Khan V. Nguyen
*Attorney, Agent, or Firm*—Wenderoth, Lind & Ponack

[57] ABSTRACT

The present invention relates to a heat insulating door wall structure for use in a refrigerator or the like. By constituting the surface of the door with a colored glass plate or the like having a transparent layer at its front surface and a colored layer at its reverse surface, a deep luster is provided by the transparent glass plate located before the colored layer. Owing to high rigidity of the glass plate, undulations that may be formed on the front surface of the door by contraction of a heat insulating material filled through expansion or foaming, or by warping of the door due to temperature differences between the exterior and interior of the door are advantageously prevented. Moreover, by increasing the strength of the door, reinforcing members of the door can be dispensed with, for a simple construction and a reduction in cost.

11 Claims, 10 Drawing Sheets

HEAT INSULATING DOOR WALL STRUCTURE

This application is a Rule 62 Continuation of now abandoned application, Ser. No. 07/972,893, filed Nov. 6, 1992, now abandoned.

BACKGROUND OF THE INVENTION

The present invention generally relates to a heat insulating door, and more particularly to a heat insulating door wall structure for use in a refrigerator or the like.

Recently, in order to improve design quality, a heat insulating door for a refrigerator has been increased in the number of its colors, with a luster imparted to the colors. Moreover, it has been a tendency to deepen the luster for further improvement of its design characteristics.

With respect to a technique related to the door wall material as referred to above, there has conventionally been proposed an arrangement as disclosed, for example, in Japanese Patent Laid-Open Publication Tokkaisho No. 61-116267 and schematically shown in FIG. 16, in which the includes an outer casing or housing 1 of a rectangular box-like configuration, with doors 2 and 3 hingedly supported a front portion of the housing 1 for selective closing opening of the housing 1. The surface of each of the doors 2 and 3 is so processed that a clear paint containing a pearl pigment or metallic pigment is applied by screen printing over the entire surface of an iron plate for subsequent baking treatment.

Meanwhile, in FIGS. 17 to 19, there is shown a door construction as disclosed in Japanese Utility Model Publication Jikkosho No. 54-17555, in which a door main body 4 includes an integral door frame 5 forming upper and lower sides and opposite side faces of the door, a door outer plate 6 fixed to the front face of the door frame 5, an expanded heat insulating material 7 of polyurethane foam or the like expanded into a space defined by the door frame 5 and the door outer plate 6, and a reinforcing plate 8 disposed at the reverse face side of the door frame 5 and subjected to integral expansion with the heat insulating material 7 so as to be held in place by the bonding force of the expanded heat insulating material 7.

In the conventional arrangement as described with reference to FIG. 16, however, there have been such problems that, in the surfaces of the doors 2 and 3, although the degree of luster may be improved even when the printing is effected onto the iron plates, owing to fine undulations or concave and convex portions on the raw material of the iron plates, such undulations can not be perfectly eliminated. In order to overcome the disadvantage as referred to above, it was considered to increase the thickness of the printed layer, but in this case, it was necessary to make the thickness of the printed layer to 1 to 2 mm for perfect elimination of the undulations on the surface, thus resulting in a high manufacturing cost. Moreover, when the above known construction is applied to the heat insulating door of the refrigerator, etc., since the inner side of the refrigerator is held at a low temperature, while the outer side of the refrigerator is maintained at a relatively high temperature, warping may be formed in the doors 2 and 3, or cracking of the printed layers may be caused by the temperature difference stated above.

When the reinforcing plate 8 is provided as shown in FIG. 19 for preventing warping of the door due to the temperature difference as described above, there have also been such problems that not only the higher cost may result, but waving is produced on the surface of the door outer plate 6 by contractions arising from the expanded heat insulating material 7 between the reinforcing plate 8 and the door outer plate 6.

As another conventional heat insulating door of this kind, there may be considered a heat insulating door for a refrigerator with a model number "NR-F46K1" manufactured by Matsushita Refrigeration Company and put on sale in February, 1990.

Referring to FIGS. 20 and 21, one example of a heat insulating door of the conventional refrigerators described so far will be explained hereinbelow.

In FIGS. 20 and 21, the heat insulating door generally includes an outer panel 9 formed by applying a decorative film **9*d* of 0.1 mm thickness, composed of a transparent layer 9*b* and a printed layer 9*c*, onto an iron plate 9*a* by a bonding agent 9*e*, an inner plate 10 disposed to confront the outer panel 9, a frame member 11 having an outer panel inserting portion 11*a* of a generally U-shaped cross section for application over an entire outer peripheral portion of the outer panel 11, an insulating material 12 filled by expansion into a space defined by the outer panel 9, the inner plate 10 and the frame member 11, and a reinforcing member 13 of a U-shaped cross section inserted in the frame member 11 at the side of the heat insulating material 12**.

In the known arrangement as described above, however, although the luster is given by the decorative film, a sufficient depth is not provided in the luster, since the decorative film cannot be made thick.

Moreover, the surface of the outer panel tends to be formed with undulations instead of being flat, due to the facts that when the decorative film is applied onto the iron plate, bubbles and dust, etc. are apt to be confined, concave and convex portions of the bonding agent or undulations on the surface of the iron plate, etc. tend to be undesirably picked up.

Meanwhile, when the heat insulating door is subjected to cooling or heating, the bonding agent is separated and raised due to differences in the linear expansion coefficients between the iron plate and the decorative film, thus forming undulations on the surface of the heat insulating door.

Another disadvantage of the conventional arrangements is that the outer panel of the insulating door tends to be formed with undulations by the heat insulating material being filled through expansion in the door.

SUMMARY OF THE INVENTION

Accordingly, an essential object of the present invention is to provide a heat insulating door wall structure for a refrigerator or the like in which the formation of very small undulations, waving or the like on the surface of the heat insulating door is prevented, so as to provide a door construction with a high degree of luster.

Another object of the present invention is to provide a heat insulating door wall structure of the above described type which is simple in construction with a high durability, and can be readily manufactured at low cost.

In accomplishing these and other objects, according to one preferred embodiment of the present invention, there is provided a heat insulating door wall structure which includes a transparent plate member, a frame member provided on an entire portion of the transparent plate member, an inner plate provided to confront the transparent plate member, and an insulating material filled through expansion in a space defined by the transparent plate member, the frame member and the inner plate.

More specifically, by constituting the surface of the door with a colored glass plate or the like having a transparent layer at its front surface and a colored layer at its reverse surface, a deep luster is provided by the transparent glass plate located before the colored layer, while owing to high rigidity of the glass plate, undulations to be formed on the front surface of the door by contraction of an insulating material filled through expansion or foaming or by warping of the door due to temperature differences between exterior and interior of the door, are advantageously prevented, and moreover, by increasing the strength of the door, reinforcing members for the door can be dispensed with for a simple construction and a reduction in cost.

BRIEF DESCRIPTION OF THE DRAWINGS

These and other objects and features of the present invention will become apparent from the following description, taken in conjunction with the preferred embodiments thereof and with reference to the accompanying drawings, in which.

DETAILED DESCRIPTION OF THE INVENTION

Figure 1:
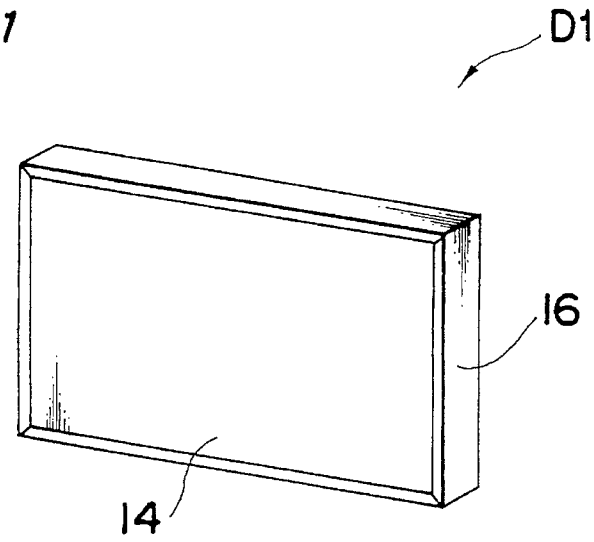
FIG. 1 is a perspective view of a heat insulating door according to one preferred embodiment of the present invention.

Before the description of the present invention proceeds, it is to be noted that like parts are designated by like reference numerals throughout the accompanying drawings.

Figure 2:
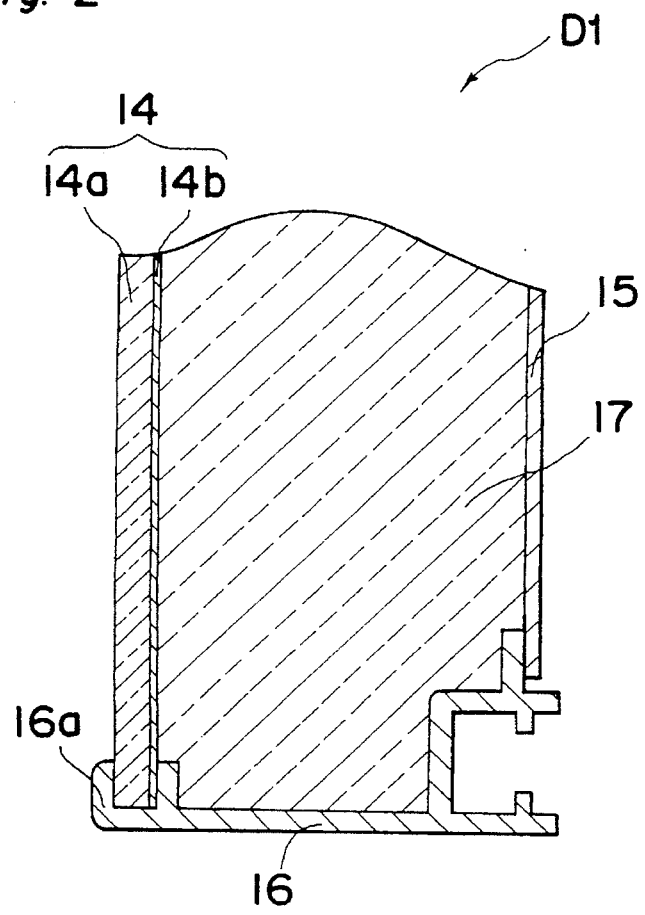
FIG. 2 is a fragmentary cross sectional view showing, on an enlarged scale, part of the heat insulating door of FIG. 1.

Referring now to the drawings, there is shown in FIGS. 1 and 2 a heat insulating door D1 according to a first embodiment of the present invention, which includes a door surface colored plate member or colored glass plate 14 having a transparent layer **14*a* at a front surface and a colored layer 14*b* fused onto a reverse surface of the transparent layer 14*a*, a frame member 16 having a colored glass plate inserting portion 16*a* formed on an entire peripheral portion thereof, an inner plate 15 provided to confront the colored glass plate 14 across a space, and a heat insulating material 17 filled, through expansion, in the space defined by the colored glass plate 14, the inner plate 15 and the frame member 16**.

By the heat insulating door D1 according to the first embodiment as described above, effects as follows can be obtained.

(1) Luster is provided by the colored glass plate 14 having the transparent layer **14*a* on its front surface, and the colored layer 14*b*** at the reverse surface, while depth may be imparted to the luster.

(2) Since the surface off the door D1 is constituted by a single part, it is not necessary to apply a decorative film onto the iron plate as in the conventional practice, and thus there is no possibility of confining bubbles, dust, etc., or forming undulations or concave and convex portions on the surface of the iron plate with the bonding agent and therefore, the surface of the heat insulating door D1 is free from undulations.

(3) Owing to the fact that the surface of the door D1 is made of a single part, there is no possibility that the bonding agent is separated and raised by differences of linear expansion coefficients upon application of cooling and heating to the heat insulating door.

(4) Since the surface of the heat insulating door D1 made of the glass plate 14 has rigidity, it is not subjected to undulation by the heat insulating material 17 filled through expansion, and thus the surface of the heat insulating door D1 is free from concave and convex portions.

(5) Although there is a possibility that the surface of the heat insulating door D1 made of the glass plate is broken, the expanded heat insulating material 17 provided at the reverse face side of the glass plate absorbs shock when an external force is applied to the glass plate, while the edges of the glass plate, which are the weakest portion, are protected by the frame member 16 so as to be free from breakage.

(6) When the heat insulating material 17 is to be expanded, it slides along the back face of the colored layer 14*b* of the glass plate 14 for efficient filling.

(7) Since the glass plate 14 has rigidity, the reinforcing plate conventionally provided in the heat insulating door may be dispensed with.

Figure 3:
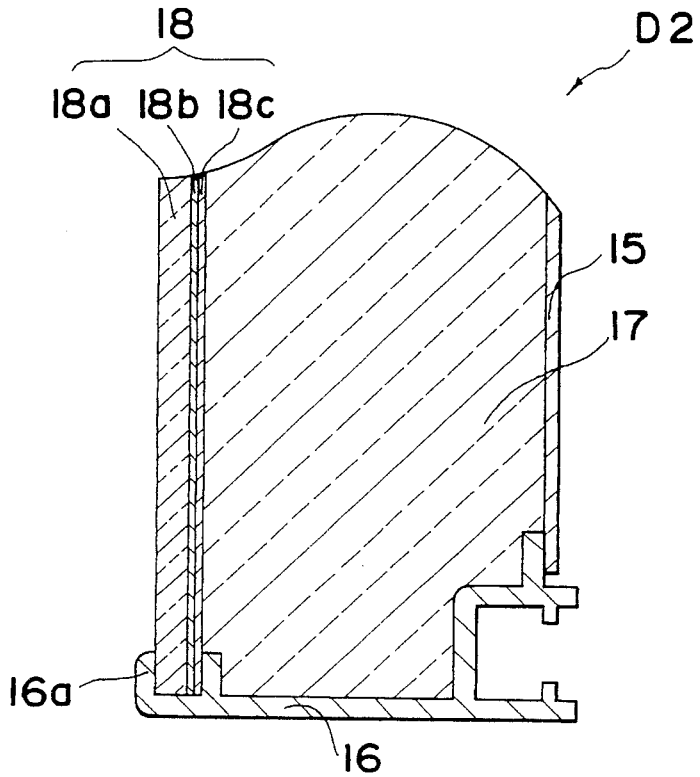
FIG. 3 is a sectional view similar to FIG. 2, which particularly restates to a second embodiment of the present invention.

Referring to FIG. 3, there is shown a heat insulating door D2 according to a second embodiment of the present invention. In this second embodiment, the colored glass plate 14 described as employed in the first embodiment of FIGS. 1 and 2 has been replaced by a glass decorative plate 18 having a transparent layer 18*a* at the front face, a transfer printing layer 18*b* provided at its reverse face side, and a print protective layer 18*c* provided at the back of the transfer printing layer 18*b*, while the other construction of the heat insulating door D2 is generally similar to the heat insulating door D1 in FIGS. 1 and 2, with like parts being designated by like reference numerals for brevity of explanation.

In the above heat insulating door D2, in addition to the effect available from the door D1 of the first embodiment, there is another effect in that various kinds of designs may be dealt with by the transfer printing.

Figure 4:
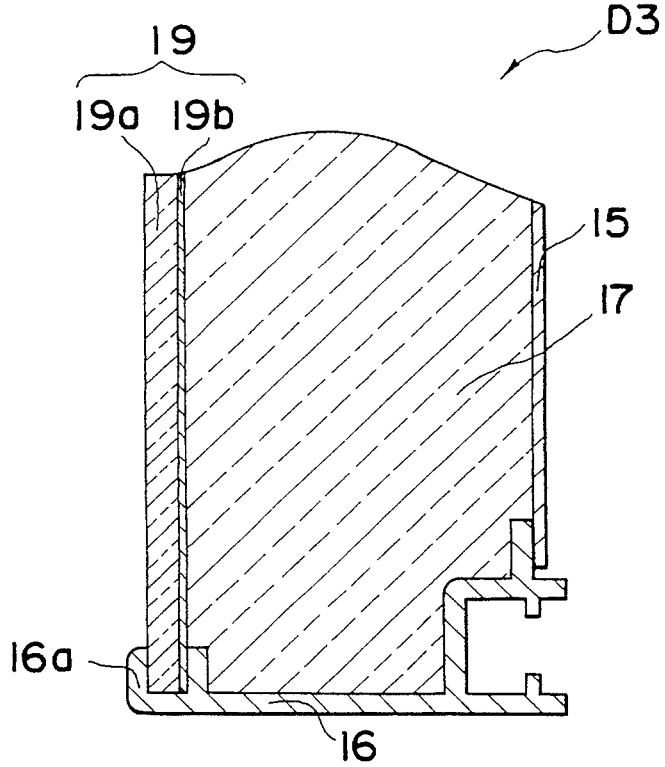
FIG. 4 is a cross sectional view similar to FIG. 2, which particularly relates to a third embodiment of the present invention.

In a heat insulating door D3 in FIG. 4, according to a third embodiment of the present invention, the colored glass plate 14 in the first embodiment of FIGS. 1 and 2 has been replaced by a reinforced colored glass plate 19 having a transparent reinforced glass layer 19*a* at the front surface, and a colored layer 19*b* at the reverse surface, while other constructions are generally similar to those in the door D1 of the first embodiment, with like parts being designated by like reference numerals for brevity.

In the heat insulating door D3 according to a third embodiment of the present invention, in addition to the effect available from the door D1 in the first embodiment, durability is further improved by using the reinforced glass, while safety is achieved even when if glass should be broken.

Figure 5:
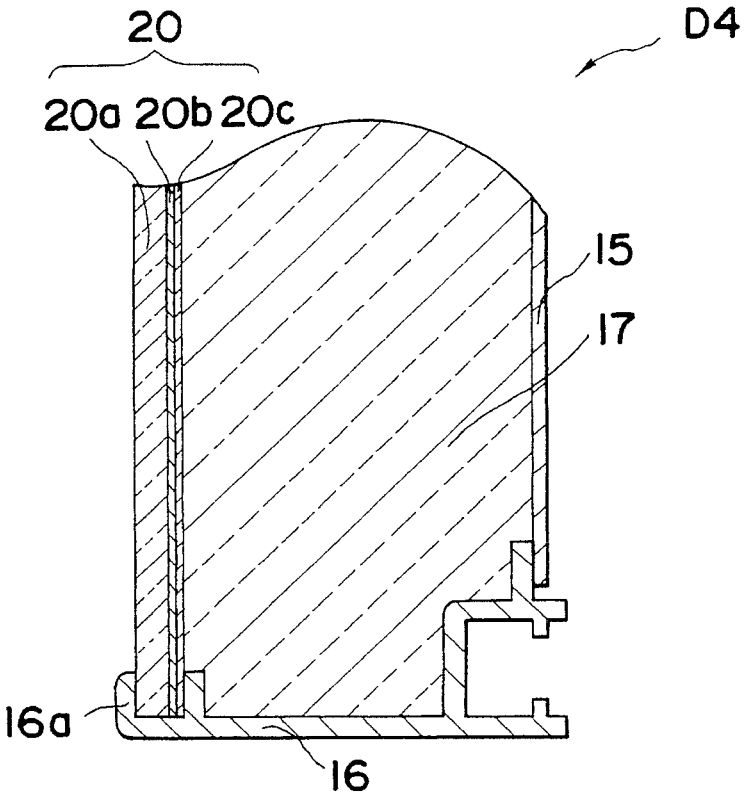
FIG. 5 is a cross sectional view similar to FIG. 2, which particularly relates to a fourth embodiment of the present invention.

Referring also to FIG. 5, there is shown a heat insulating door D4 according to a fourth embodiment of the present invention, in which the colored glass plate 14 described as employed in the door D1 of the first embodiment has been replaced by a reinforced decorative glass plate 20 having a transparent glass layer 20*a* at the front surface, a transfer printing layer 20*b* provided at the reverse surface side of the reinforced glass layer 20, and a printing protective layer 20*c* provided at the back of the transfer printing layer 20. Other constructions are generally similar to those in the door D1 of the first embodiment, with like parts being designated by like reference numerals for brevity.

In the heat insulating door D4 according to the fourth embodiment of the present invention, in addition to the effect available from the door D2 in the second embodiment, there are also obtained such effects in that the durability is further improved by the employment of the reinforced glass, and safety is maintained even upon breakage of the glass.

Figure 6:
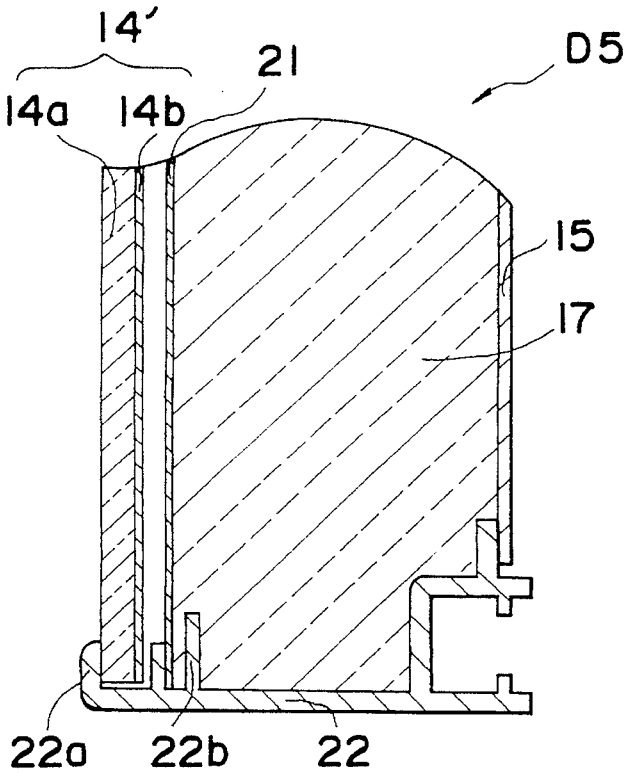
FIG. 6 is a cross sectional view similar to FIG. 2, which particularly relates to a fifth embodiment of the present invention.

Referring further to FIG. 6, there is shown a heat insulating door D5 according to a fifth embodiment of the present invention.

The heat insulating door D5 generally includes a colored glass plate 14' having a transparent layer 14*a* at the front surface and a colored layer 14*b* at the reverse face side, an outer plate 21 of an iron plate disposed at the reverse face side of the colored glass plate 14', a frame member 22 having a glass plate inserting portion 22*a* and an outer plate inserting portion 22*b* in a generally E-shaped cross section for fitting over the entire peripheral portions of the colored glass plate 14' and the outer plate 21, an inner plate 15 provided to confront the outer plate 21, and a heat insulating material 17 filled, through expansion, in a space defined by the outer plate 21, the frame member 22, and the inner plate 15.

By the heat insulating door D5 according to the fifth embodiment of the present invention as described above, effects as follows may be achieved.

(1) Luster is provided by the glass plate 14' located before the printing portion, while depth may be imparted to the luster.

(2) Since the surface of the door D5 is constituted by a single part without being bonded together, it is not necessary to apply a decorative film onto the iron plate as in the conventional practice, and thus there is no possibility of confining bubbles, dust, etc., or forming undulations or concave and convex portions on the surface of the iron plate with the bonding agent, and accordingly, the surface of the heat insulating door D5 is free from undulations.

(3) Owing to the fact that the surface of the door is made of a single part, there is no possibility that the bonding agent is separated and raised by the difference in the linear expansion coefficients upon application of cooling and heating to the heat insulating door.

(4) Since the outer plate 21 is provided at the back of the glass plate 14' for the front surface of the heat insulating door D5, the undulations formed by the heat insulating material 17 filled in through expansion are stopped at the outer plate 21, and thus there is no possibility that undulations are formed on the front surface of the heat insulating door D5.

(5) Although there is a possibility that the surface of the heat insulating door D5 made of the glass plate 14' is broken, the expanded heat insulating material 17 provided at reverse face side of the glass plate absorbs shock when external force is applied to the glass plate, and thus breakage of the glass plate is prevented.

(6) Since the glass plate 14' has rigidity, the reinforcing members conventionally included in the heat insulating door may be dispensed with.

(7) Owing to the construction that the frame member 22 has the glass plate inserting portion 22*a* and the outer plate inserting portion 22*b* generally in the E-shaped cross section, the colored glass plate may be simply replaced by mere fitting or removing thereof.

Figure 7:
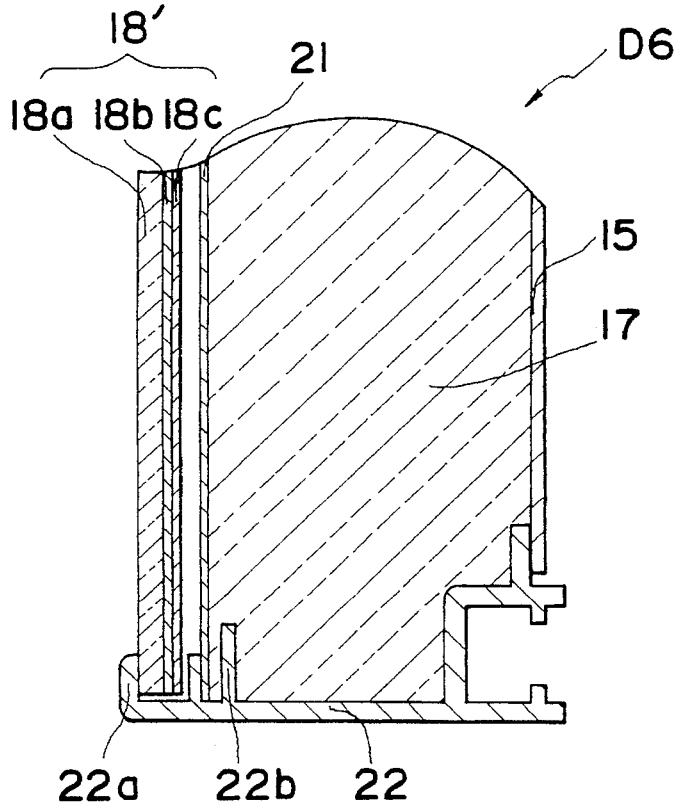
FIG. 7 is a cross sectional view similar to FIG. 2, which particularly relates to a sixth embodiment of the present invention, FIG. 8 As a cross sectional view similar to FIG. 2, which particularly relates to a seventh embodiment of the present invention.

FIG. 7 shows a heat insulating door D6 according to a sixth embodiment of the present invention in which the colored glass plate 14' described as employed in the heat insulating door D5 for the fifth embodiment has been replaced by a glass decorative plate 18' having a transparent layer 18*a* at the front face, a transfer printing layer 18*b* provided at its reverse face side, and a print protective layer 18*c* provided at the back of the transfer printing layer 18*b*. Since other constructional features of the heat insulating door D6 are generally similar to those of the door D5 of FIG. 6, a detailed description thereof has been abbreviated here, with like parts being designated by like reference numerals.

In the above heat insulating door D6, in addition to the effect available from the door D5 of the fifth embodiment, there is another effect in that various kinds of designs may be dealt with by the transfer printing.

Figure 8:
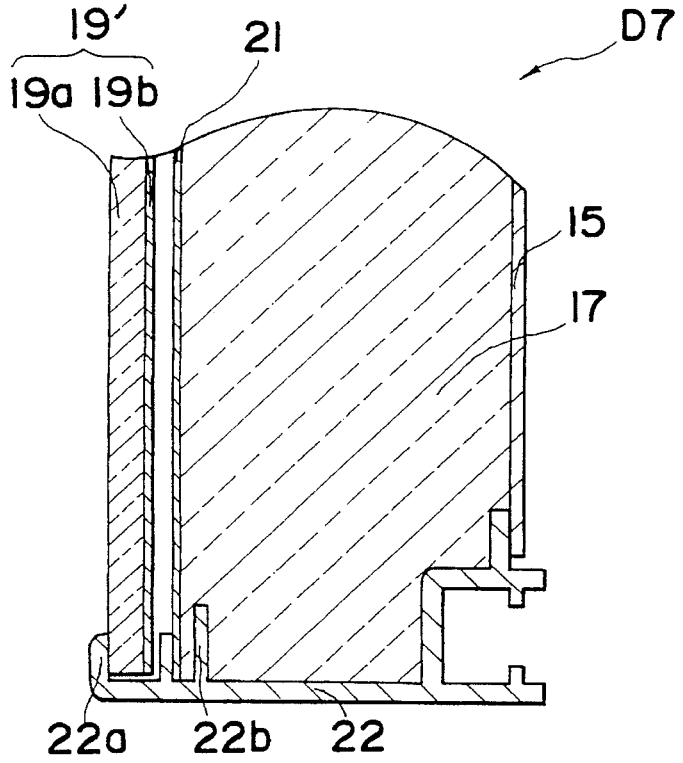

In a heat insulating door D7 in FIG. 8 according to a seventh embodiment of the present invention, the colored glass plate 14' in the heat insulating door D5 of the fifth embodiment in FIG. 6 has been replaced by a reinforced colored glass plate 19' having a transparent reinforced glass layer 19*a* at the front surface, and a colored layer 19*b* at the reverse surface, while other constructional features are generally similar to those in the door D5 of the fifth embodiment, and with like parts being designated by like reference numerals for brevity.

In the heat insulating door D7 according to the seventh embodiment of the present invention, in addition to the effect available from the door D5 in the fifth embodiment, the durability is further improved by using the reinforced glass 19', while safety is achieved even if the glass should be broken.

Figure 9:
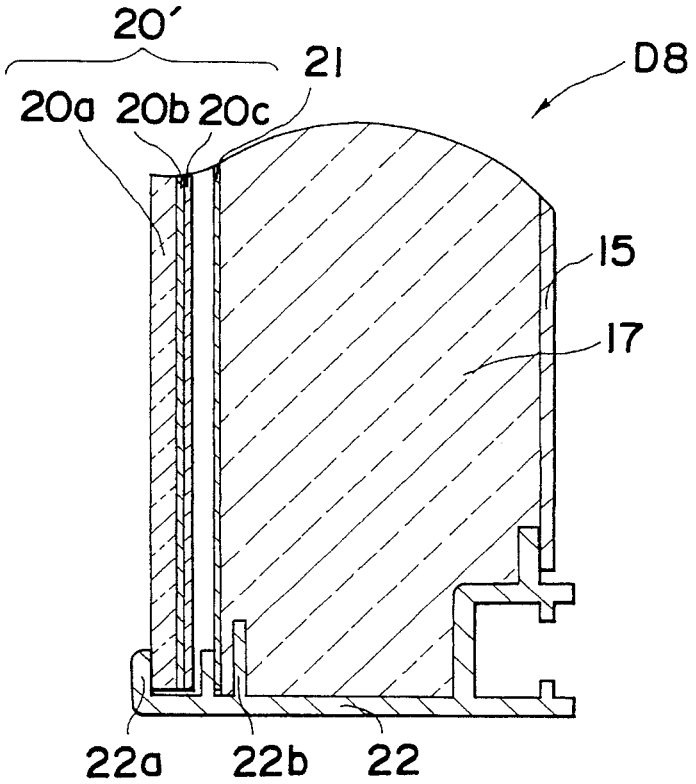
FIG. 9 is a cross sectional view similar to FIG. 2, which particularly relates to an eighth embodiment of the present invention.

Referring also to FIG. 9, there is shown a heat insulating door D8 according to an eighth embodiment of the present invention, in which the colored glass plate 14' described as employed in the door D5 of the fifth embodiment has been replaced by a reinforced decorative glass plate 20' having a transparent reinforced glass layer 20*a* at the front surface, a transfer printing layer 20*b* provided at the reverse surface side of the reinforced glass layer 20*a*, and a printing protective layer 20*c* provided at the back of the transfer printing layer 20*b*. Other constructional features are generally similar to those in the door D5 of the fifth embodiment, with like parts being designated by like reference numerals for brevity.

In the heat insulating door D8 according to the eighth embodiment of the present invention in addition to the effect available from the door D5 in the fifth embodiment, there are also obtained such effects in that the durability is further improved by the employment of the reinforced glass, and safety is maintained even upon breakage of the glass.

Figure 10:
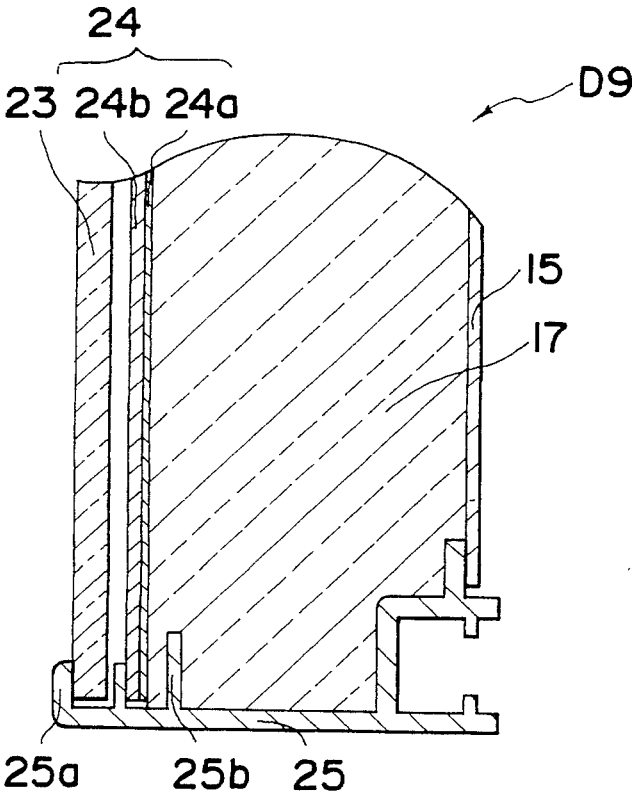
FIG. 10 is a cross sectional view similar to FIG. 2, which particularly relates to a ninth embodiment of the present invention.

Referring further to FIG. 10, there is shown a heat insulating door D9 according to a ninth embodiment of the present invention, which includes a transparent glass plate 23, an outer plate 24 having an iron plate 24*a* and a printing portion 24*b* and disposed at the reverse face side of the glass plate 23, a frame member 25 having a glass plate inserting portion 25*a* and an outer plate inserting portion 25*b* generally in an E-shaped cross section for fitting onto the entire outer peripheral portions of the glass plate 23 and the outer plate 24, an inner plate 15 provided to confront the outer plate 24, and a heat insulating material 17 filled through expansion, in a space defined by the outer plate 24, the frame member 25, and the inner plate 15.

By the heat insulating door D9 according to the ninth embodiment of the present invention as described above, effects as follow can be obtained.

(1) Luster is provided by the glass plate located before the printing portion, while depth may be imparted to the luster.

(2) Since the surface of the door D9 is constituted by a single part, without being bonded together, it is not necessary to apply a decorative film onto the iron plate as in the conventional practice, and thus there is no possibility of confining bubbles, dust, etc., or forming undulations by the bonding agent or concave and convex portions on the surface of the iron plate, and therefore the surface of the heat insulating door D9 is free from undulations.

(3) Owing to the fact that the surface of the door D9 is made of a single part, there is no possibility that the bonding agent is separated and raised by a difference in linear expansion coefficients upon application of cooling and heating to the heat insulating door D9.

(4) Since the outer plate 15 is provided at the back of the glass plate for the front surface of the heat insulating door D9, the undulations formed by the heat insulating material 17 filled through expansion are stopped at the outer plate 15, and thus there is no possibility that undulations are formed on the front surface of the heat insulating door.

(5) Although there is a possibility that the surface of the heat insulating door D9 made of glass plate 23 is broken, the expanded heat insulating material 17 provided at the reverse face side of the glass plate 23 absorbs shock when an external force is applied to the glass plate, and thus breakage of the glass plate is prevented.

(6) Since the glass plate 23 has rigidity, the reinforcing members conventionally included in the heat insulating door may be dispensed with.

Figure 11:
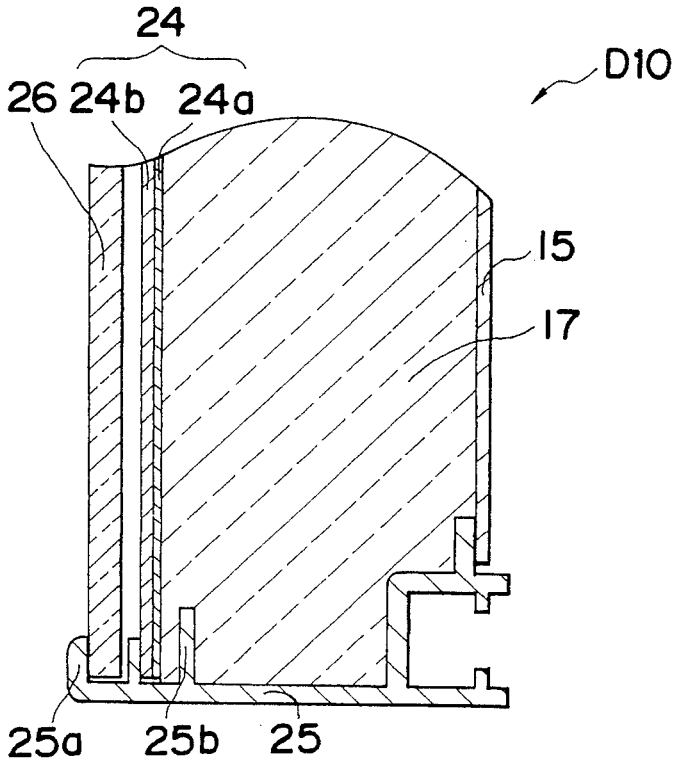
FIG. 11 is a cross sectional view similar to FIG. 2, which particularly relates to a tenth embodiment of the present invention.
Figure 12:
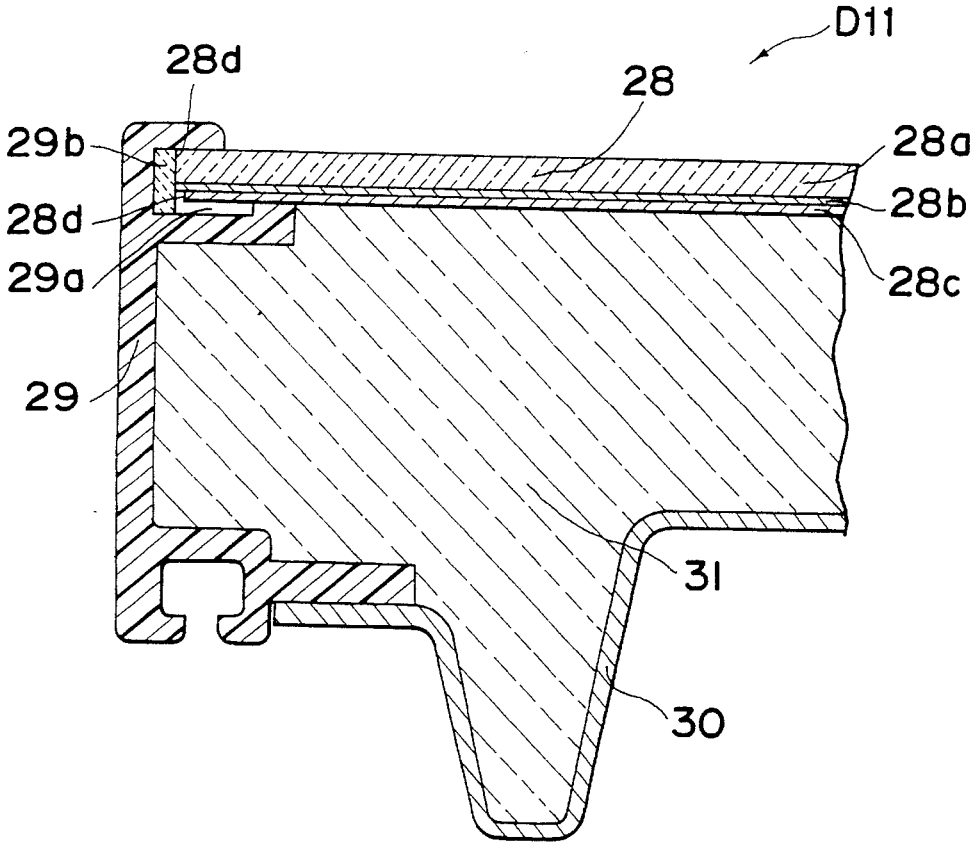
FIG. 12 is a fragmentary top plan sectional view showing 100 on an enlarged scale, part of a heat insulating door according to an eleventh embodiment of the present invention taken along line XII—XII in FIG. 13.
Figure 13:
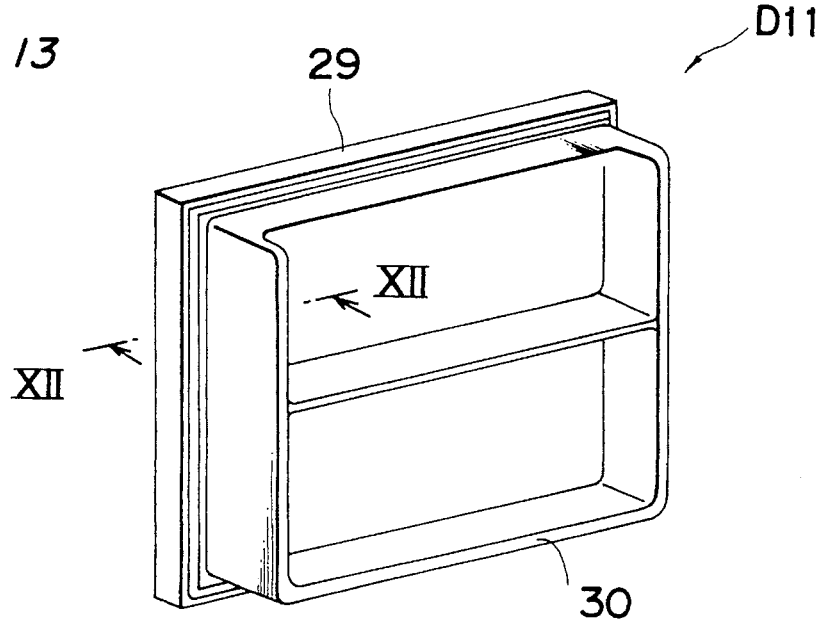
FIG. 13 is a perspective view showing the entire heat insulating door of FIG. 12.
Figure 14:
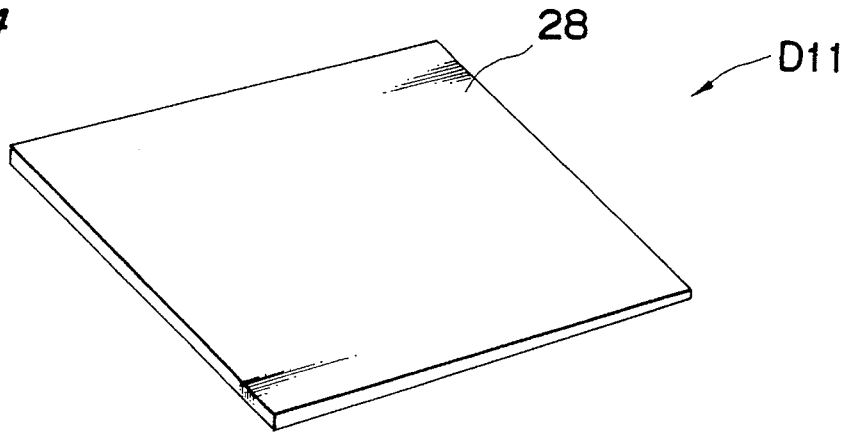
FIG. 14 is a perspective view of an outer plate employed in the heat insulating door of FIG. 12.
Figure 15:
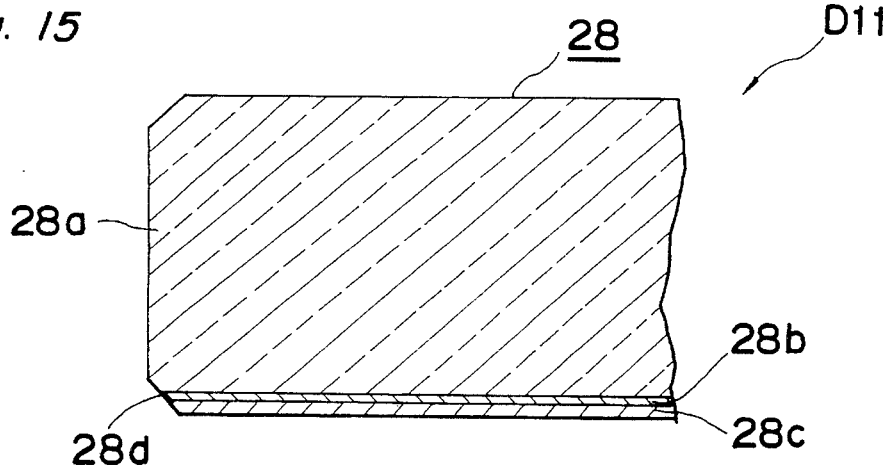
FIG. 15 is a fragmentary side sectional view showing, on an enlarged scale part of the outer plate of FIG. 14.
Figure 16:
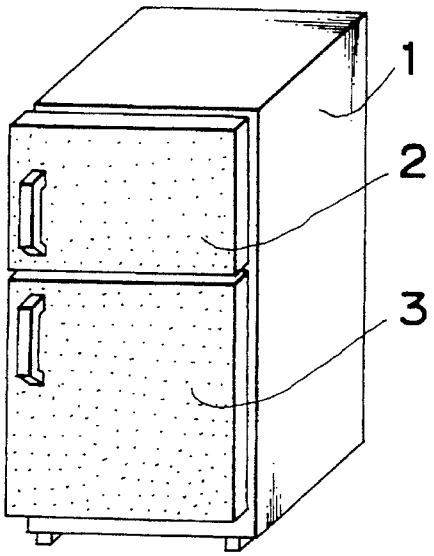
Fig. 16 PRIOR ART
FIG. 16 is a perspective view of a refrigerator provided with conventional heat insulating doors (already referred to)
Figure 17:
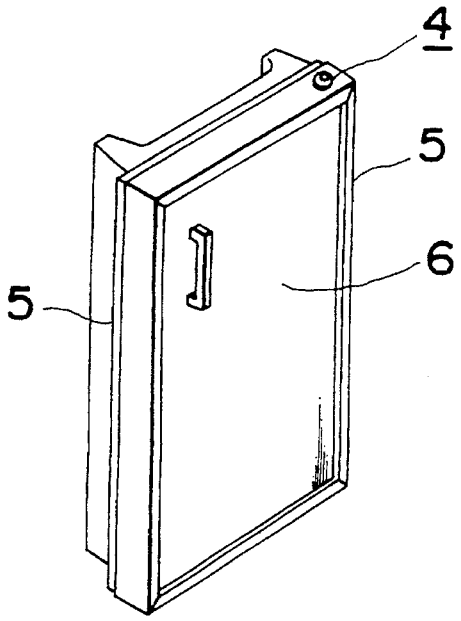
Fig. 17 PRIOR ART
FIG. 17 is a perspective view showing one example of a conventional heat insulating door (already referred to)
Figure 18:
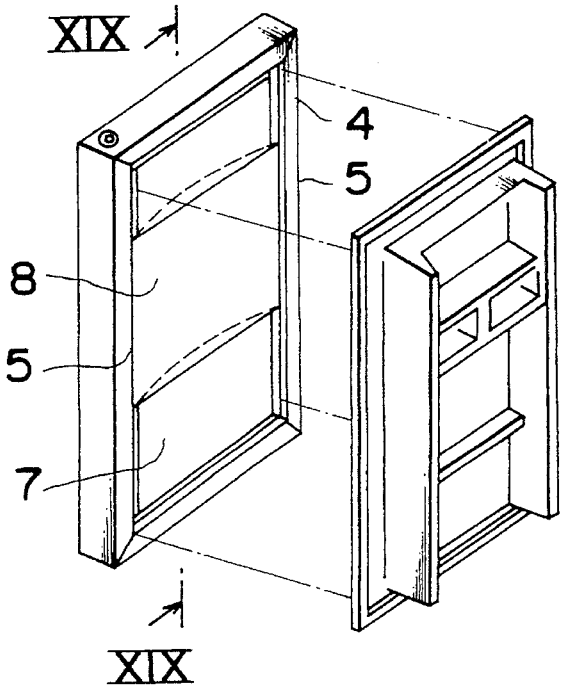
Fig. 18 PRIOR ART
FIG. 18 is an exploded perspective view of the conventional heat insulating door of FIG. 17 (already referred to)
Figure 19:
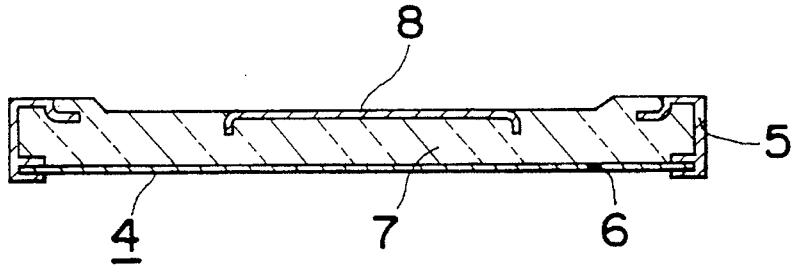
Fig. 19 PRIOR ART
FIG. 19 is a cross section taken along line XIX— XIX in FIG. 18 (already referred to)
Figure 20:
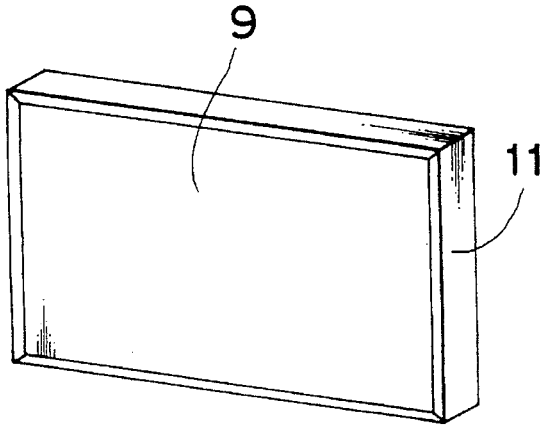
Fig. 20 PRIOR ART
FIG. 20 is a perspective view of another conventional heat insulating door (already referred to)
Figure 21:
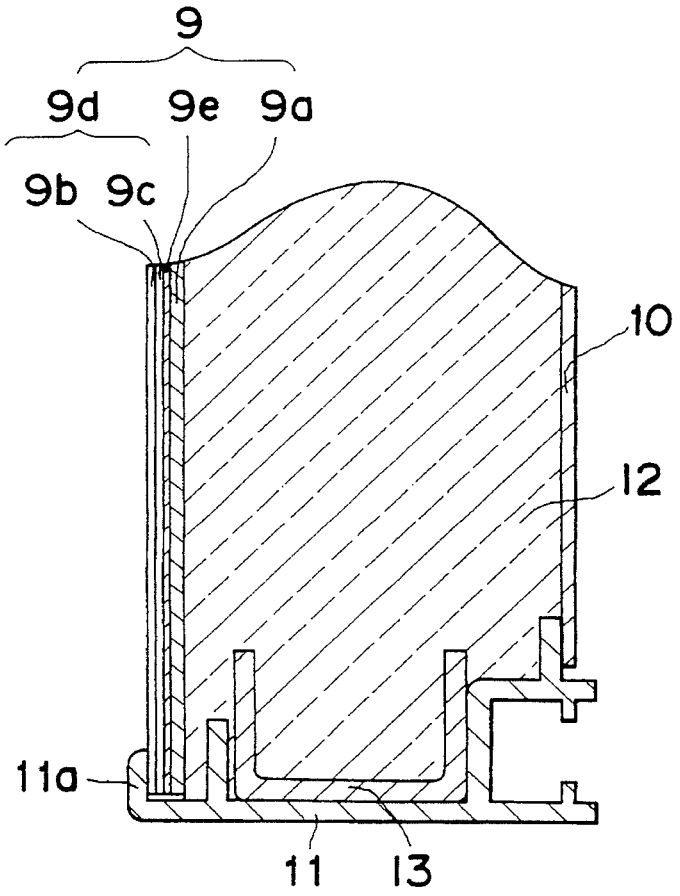
Fig. 21 PRIOR ART
FIG. 21 is a fragmentary cross sectional view showing, on an enlarged scale, part of the conventional heat insulating door of FIG. 20 (already referred to).

FIG. 11 shows a heat insulating door D10 according to a tenth embodiment of the present invention, in which the glass plate 23 described as employed in the heat insulating door D9 for the ninth embodiment in FIG. 10 has been replaced by a transparent reinforced glass plate 26. Since other constructional features of the heat insulating door D10 are generally similar to those of the door D9 of FIG. 10, a detailed description thereof has been abbreviated here, with like parts being designated by like reference numerals.

In the heat insulating door D10 according the tenth embodiment of the present invention, in addition to the effect available from the door D9 in the ninth embodiment, the durability is further improved by using the reinforced glass, while safety is achieved even if the glass should be broken.

Referring further to FIGS. 12 to 15, there is shown a construction of a heat insulating door D11 for use in a refrigerator or the like according to an eleventh embodiment of the present invention.

In FIGS. 12 to 15, the heat insulating door D11 generally includes an outer plate 28 having a glass plate 28*a* at a front face, a colored layer 28*b* colored or formed with patterns by transfer printing over the reverse surface of the glass plate 28*a*, a protective layer 28*c* formed on the colored layer 28*b*, a chamfered portion 28*d* formed around the outer peripheral edge of the outer plate 28, a door frame member 29 fixed to the outer periphery of the outer plate 28, an outer plate inserting groove 29*a* having an approximately an U-shaped cross section so as to be fitted over the edges on the outer plate 28, a flexible member 29*b* integrally formed with the door frame 29 and contacting the outer peripheral portion of the outer plate 28, a door inner plate 30 formed by vacuum molding with resin supported about its entire periphery by the door frame 29 a predetermined distance from the outer plate 28, and a heat insulating material 31 filled through expansion in a space defined by the door inner plate 30, the door frame 29, and the outer plate 28.

In the above arrangement of the heat insulating door D11, since the outer plate 28 is constituted by the glass plate 28*a*, the appearance of the surface of the heat insulating door D11 may be improved by the luster and flatness of the glass plate 28*a*, while a higher strength of the door is achieved by the hardness of such glass plate, and thus the reinforcing members conventionally required may be dispensed with for a reduction in cost. Moreover, the undulations or wavings on the surface of the outer plate 28 by the contraction of the expanded heat insulating material 31 can be advantageously prevented. Owing to the arrangement that the colored layer 28*b* and the protective layer 28*c* are formed on the reverse surface of the glass plate 28*a*, design effect on the surface of the outer plate 28 can be achieved by the coloring layer 28*b*, while heat influence on the colored layer 28*b* during expansion of the heat insulating material 31, and damage to the colored layer 28*b* during assembling, are prevented by the presence of the protective layer 28*c*.

Furthermore, by the chamfered portion 28*d* being formed on the outer plate 28, safety during assembling, and improvement in the efficiency of insertion of the outer plate 28 into the outer plate inserting groove 29*a* of the door frame member 29 can be achieved. Meanwhile, by the flexible member 29*b* being formed in the door frame member 29, the outer peripheral portion of the outer plate 28 is protected, and thus cracking from the end face of the glass plate 28*a* by the impact to the outer plate 28 may be prevented.

Additionally, since the expanded heat insulating material 31 is held in close contact with the outer plate 28, there is no possibility of cracking, even if external forces or impacts are applied to the outer plate 28, and even when cracking takes place, the scattering of glass pieces is advantageously prevented.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A heat insulating door wall structure, comprising:

a colored glass plate member which comprises a transparent glass layer located at a front face of said colored glass plate member and a colored layer located at a reverse face of said transparent glass layer, said colored glass plate member having a peripheral portion;

an outer plate disposed at a reverse surface side of said colored glass plate member, said outer plate having a peripheral portion;

a frame member disposed so as to surround said peripheral portions of said colored glass plate member and said outer plate;

an inner plate confronting said outer plate, wherein said inner plate, said outer plate and said frame member define a space therebetween; and an expanded heat insulating material filled in said space;

wherein said colored layer is located between said transparent glass layer and said expanded heat insulating material.

2. The heat insulating door wall structure of claim 1, wherein said colored layer comprises a transfer printing layer located at the reverse face of said transparent glass layer and a printing protective layer is disposed at a reverse face of said transfer printing layer.

3. The heat insulating door wall structure of claim 2, wherein said transparent glass layer comprises a reinforced glass plate.

4. The heat insulating door wall structure of claim 1, wherein said transparent glass layer comprises a reinforced glass plate.

5. A heat insulating door wall structure, comprising:

a transparent glass plate having a front face, a reverse surface and a peripheral portion;

an outer plate disposed at the reverse surface of said transparent glass plate, said outer plate having a printed portion at a front surface thereof and a peripheral portion;

a frame member disposed so as to surround said peripheral portions of said transparent glass plate and said outer plate;

an inner plate disposed so as to confront said outer plate, wherein said inner plate, said outer plate and said frame member define a space therebetween; and an expanded heat insulating material filled in said space;

wherein said printed portion is located between said transparent glass plate and said expanded heat insulating material.

6. The heat insulating door wall structure of claim 5, wherein said transparent glass plate comprises a reinforced glass plate.

7. A heat insulating door wall structure, comprising:

an outer plate which comprises a glass plate member having a colored layer on a reverse surface thereof, a protective film protecting said colored layer and a peripheral portion having a peripheral edge;

a door frame member fixed onto said peripheral portion of said outer plate;

a door inner plate mounted a predetermined distance from said outer plate, wherein said door inner plate, said outer plate and said door frame member define a space therebetween; and an expanded heat insulating material filled in said space;

wherein said colored layer is located between said transparent glass layer and said expanded heat insulating material.

8. The heat insulating door wall structure of claim 7, wherein said door frame member is molded of hard resin and has a flexible member integrally formed therewith adapted to contact said peripheral edge of said outer plate.

9. The heat insulating door wall structure of claim 7, wherein said peripheral portion of said outer plate is chamfered at said peripheral edge.

10. A heat insulating door wall structure comprising:

a colored glass plate member which comprises a transparent layer located at a front face of said colored glass plate member, a transfer printing layer located at the reverse face of said transparent layer, and a printing protection layer located at the reverse face of said transparent layer to protect said transfer printing layer, a frame member entirely surrounding the peripheral portion of said colored glass plate member, an inner plate disposed so as to confront said colored glass plate member, wherein said colored glass plate member, said frame member and said inner plate define a space therebetween, and an expanded heat insulating material filled in the space between said colored glass plate member, said frame member and said inner plate.

11. A heat insulating door wall structure as claimed in claim 10, wherein said colored glass plate member comprises a reinforced glass plate.

* * * * *